United States Patent [19]

Roberts

[11] 4,289,323

[45] Sep. 15, 1981

[54] WHEEL IMPROVEMENT FOR ROLLER SKATES

[76] Inventor: Marvin Roberts, 7645 Densmore Ave., Van Nuys, Calif. 91406

[21] Appl. No.: 65,536

[22] Filed: Aug. 10, 1979

[51] Int. Cl.[3] ..... A63C 17/14

[52] U.S. Cl. ..... 280/11.21; 301/5.7

[58] Field of Search ..... 280/11.21, 11.2, 11.115; 301/5.7

[56] References Cited

U.S. PATENT DOCUMENTS

| | | | |
|---|---|---|---|
| 880,519 | 3/1908 | Graffenberger | 280/11.21 X |
| 1,551,571 | 9/1925 | Kenney | 280/11.21 |
| 2,165,996 | 7/1939 | Chiles | 280/11.21 X |
| 2,649,337 | 8/1953 | Ware | 301/5.7 |

*Primary Examiner*—John P. Silverstrim
*Assistant Examiner*—Milton L. Smith
*Attorney, Agent, or Firm*—Roger A. Marrs

[57] ABSTRACT

A wheel for a skating apparatus is operably carried on a truck so as to selectively rotate in a given direction or in both directions. A bearing assembly rotatably mounts the wheel on one end of an axle outwardly projecting from a skate truck. The bearing assembly includes a pair of races between which bearings are rollably disposed. An adjustable bearing assembly is operably coupled between the opposing surfaces of the truck and the inside of the wheel. Bearings in this latter assembly are rollable in a circular cage having the bearing surfaces engagable with a flat raceway carried on the truck wherein the wheel rotates in a first direction when the bearing engages with a circular portion of an eccentric and ceases rotation when the bearing engages with a flattened ramp portion of the eccentric. In an alternate embodiment the first mentioned bearing assembly includes the eccentric raceway on one side of the cage holding the bearings and the flat surface race on the opposite side.

4 Claims, 5 Drawing Figures

WHEEL IMPROVEMENT FOR ROLLER SKATES

BACKGROUND OF THE INVENTION

1. Field of the Invention

This invention relates to wheeled apparatus and more particularly to a novel improvement in wheel construction for roller skates or the like enabling the wheels to selectively rotate in a forward direction only or in a forward/reverse direction.

2. Brief Description of the Prior Art

The evolution of roller skates during the past few decades has changed from clamp-on roller skates to shoe skates, providing better bearings, wider, plastic wheels and front and/or rear stops. The standard motions of the legs and body while skating have not been affected substantially by these changes.

There are a number of differences in the techniques and style of skating with conventional skates and skates based on the subject invention. These differences are significant because they relate to safety, energy required for skating, strain on the body of the skater, learning period for beginning skaters, style, and ability to skate uphill. Each of these differences is discussed more fully in the following paragraphs.

The chief features of conventional roller skates contributing to safety are shoe skates (as opposed to clamp-on skates), wide wheels, sturdy construction, and toe and back stops. The subject invention can incorporate the features of integral shoes, wide wheels and strudy construction, but it goes much further.

First, the front stop can be eliminated. The front stop is a hazard for inexperienced skaters and sometimes can be a disadvantage to experienced skaters.

Speed skaters often use toe stops for quick starts, literally starting off running on the toe stop although the name "toe stop" implies that it is for braking the skater's motion. When it is used for braking, the body and legs are in an awkward and unsafe position, poorly balanced, and the skater is prone to fall or have an accident. With the inventive wheel arrangement incorporated into a skate, there is no necessity for a toe stop; starts are accomplished without overbalancing the body in a forward position, and there is no strain on toes, feet, or legs as when a speed skater starts by running on his toe stops. The legs and feet are straight and the wheels lock when thrust is exerted for rapid starts.

The other common way to get off to a fast start is to turn the ankle some 90 degrees to the direction of motion. Again with the one-way skate there is no need to turn the foot at all.

With conventional skates, either toe or back stops can be used for braking action. Another way to come to a quick stop is to turn both skates about 90 degrees to the direction of travel, and lean backward so the feet are ahead of the body. Any of these stopping techniques can be used with the one-way skates of the inventive concept, except that if the skates are turned, to take full advantage of the locking action for braking, the feet must be turned more than 90 degrees. If the skater comes to a stop on an incline with conventional skates, he must twist his ankles and tense his legs to keep from rolling backwards. With the inventive skates, his feet and legs remain straight and there is no tension; the one-way skatewheel of the present invention automatically does the work for him by preventing the wheels from turning backward.

Before a beginning skater learns to coordinate body, leg, and foot movements he frequently finds his skates are trying to roll backwards while he is trying to go forward. Often, this uncoordinated motion causes falls and injuries. The skates of the subject invention prevent backward turning of the wheels and for this reason are ideal for beginning skaters. In addition, the motions are far simpler—only forward, straight movement of the legs is required. Legs and feet do not have to move outwardly, (frequently the cause of other spills strains, sprains, and other injuries). Arms do not have to be trained to move in harmony with the feet to achieve successful forward motion. As long as the skater's body leans slightly foward in natural walking stride, his skates will not shoot out from under him and cause him to fall backwards. This single type of fall is perhaps the largest contributor of spinal injuries to skaters. For speed and marathon skaters there are additional safety advantages gained when one-way skatewheels of the present invention are used. There is less strain on the back, legs, and toes since all forward motion is direct, in a straight line much like walking, and no angular motions are needed. Because of these factors, minimum effort is required so that a skater can potentially skate faster, or for a longer period, or for a greater distance with less fatigue or next-day body aches. Finally, skating up a steep incline or hill is difficult with conventional skates. In some cases it is necessary to go up in a tacking motion. On steeper slopes the skater must sidestep his way up the hill. This takes practice and is very tiring. Using the new skates, the skater simply moves his legs straight forward up the hill. Once forward motion ceases, the one-way wheel prevents the skate from rolling backwards while the opposite foot moves to a new position higher up the slope.

SUMMARY OF THE INVENTION

Accordingly, the above mentioned problems and difficulties are obviated by the present invention which provides a wheel apparatus for a skating device or the like that includes rollably mounting a wheel to a fixed structure such as by an axle carried by a truck.

In one form of the invention, a rotor is carried on the inside surface of the wheel having a smooth and flat raceway while a stator carried by the truck includes a raceway having a plurality of eccentric cavities facing the rotor raceway. A cage movably supporting a plurality of bearings is disposed between the raceways wherein each bearing resides in an associated cavity. Each cavity displays a flat ramp portion adapted to block rolling of its associated bearing and a circular portion co-extensive with the ramp adapted to permit rolling of the bearing. Adjustment means interconnect the rotor and stator to selectively provide for freewheeling in both forward and reverse directions and for rotation in only the forward direction.

Therefore, it is among the primary objects of this invention to provide an improvement for roller skates, skateboards or the like to make them safer, easier for beginners to use, and more maneuverable. In addition, less energy is required by the skater in using the improved skates, an advantage particularly important for speed and distance skating. Also, the skates employing the wheeled apparatus can be used for skating up hills.

Another object of the present invention is to provide a change in skate design and construction that completely alters traditional skating and enables the skates to move forward without the angular motions of feet and legs, slanting thrust of the torso, and attendant swing of the arms to attain forward motion.

Still a further object of the inventive concept includes providing an adjustable means for manually selecting between a free-wheeling condition and a solely forward moving condition for a wheeled apparatus whereby improved maneuverability and performance characteristics are achieved in skating devices and apparatus.

A further object of the present invention resides in an improved wheel construction for a skate device permitting rolling in forward direction only.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

As stated earlier, roller skates employ wheels which are free to rotate both in a forward and backward direction. Unless the skater is performing certain maneuvers or skating backwards, there is no requirement for the wheels to turn both ways since they need only rotate to allow forward motion.

Figure 1:
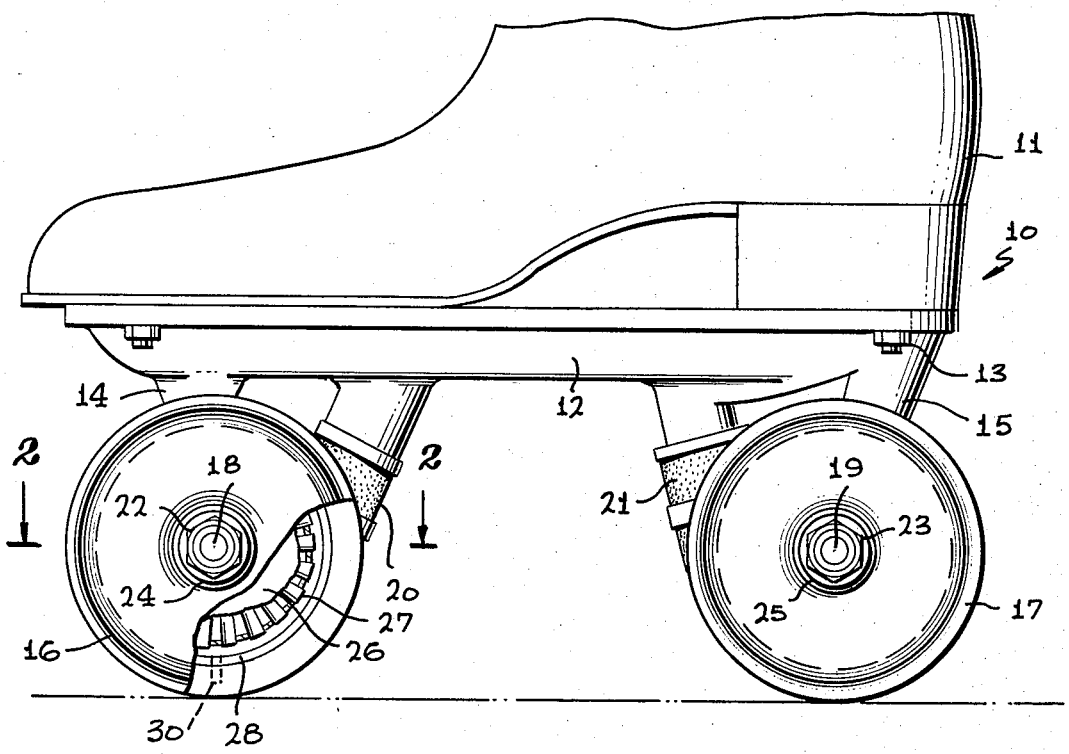
FIG. 1 is a side elevational view of a shoe type roller skate incorporating the novel wheel apparatus of the present invention.

Referring now in detail to FIG. 1, a shoeskate is indicated in the general direction of arrow 10 which incorporates a device or means to enable the wheels to turn in a forward direction only. The shoeskate incorporates a shoe 11 which is worn on the foot of the user and includes a plate 12 which is secured to the sole of the shoe 11 by a plurality of mounting bolts 13. The plate 12 includes forward and rear trucks 14 and 15 which rotatably support wheels 16 and 17 by means of axles 18 and 19 respectively. It is to be understood that although only wheels 16 and 17 are illustrated, identical wheels are carried on the opposite end of the axles 18 and 19 respectively. Cushions 20 and 21 are employed on an action bolt for providing a smooth ride. Each wheel 16 and 17 is held on the respective axles 18 and 19 by nuts 22 and 23 tightened against a bearing assembly 24 and 25. If desired, a toestop may be incorporated at the front of the plate 12 and a backstop may be carried from the rear of the plate. As described, the above shoeskate is conventional. However, the present invention is illustrated in the broken-away portion of the front wheel 16 which illustrates the novel wheel and bearing assembly incorporating the present invention.

As can be seen through the broken-away portion of wheel 16, a rotor 26 is provided which serves as one of a pair of raceways for a plurality of bearings, such as bearing 27. The other raceway for the assembly is provided by a stator identified by numeral 28. Preferably, the stator is movable with respect to the plurality of bearings by means of a lever arm 30 so that one of two positions can be assumed by the stator. When the lever arm 30 is in one position, the wheels will turn in a forward direction only; when the lever arm 30 is in its second position, the wheels will freewheel in both directions.

Figure 2:
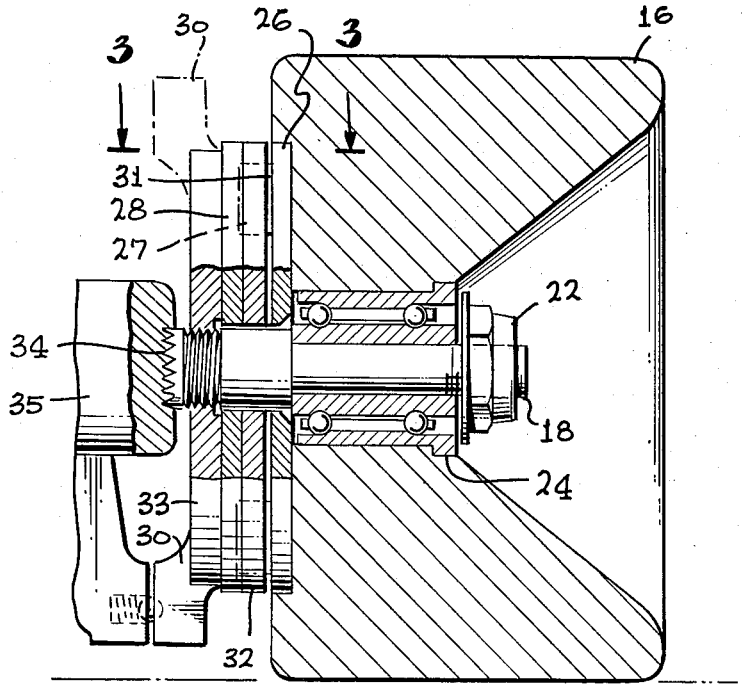
FIG. 2 is a transverse cross-sectional view of the wheel apparatus shown in FIG. 1 as taken in the direction of arrows 2—2 thereof.

FIG. 2 shows a preferred embodiment of a one-way device that is employed so that the wheel and/or wheels of the skate 10 which are thus equipped will rotate only in a forward direction. In this forward-looking view of the right front roller skate wheel 16, the rotor 26 is integral with the inner surface of the wheel 16 and the stator 28 may be adjusted for free wheeling or one-way rotation. Wheel 16 rotates on radial ball bearings 27 about axle or shaft 18 in the conventional manner. However, the inner surface of the wheel is provided with the rotor plate 26 having a flat hardened surface 31 serving as a raceway. Adjacent to this inner surface of the rotor is the stator 28 assembly that mounts on shaft 18, and which includes a thrust bearing 32. Nest to the stator is an adjusting plate 33 with the integral arm 30 to permit manual switching from "off" to "on" of the one-way mechanism. Adjustment of the mechanism to compensate for thread start position, wear, etc., is made by repositioning the toothed, threaded bushing 34 in the mating toothed spindle 35 of the skate truck 14. The entire wheel and one-way mechanism assembly is held on the threaded shaft 18 by the nut 22.

Figure 3:
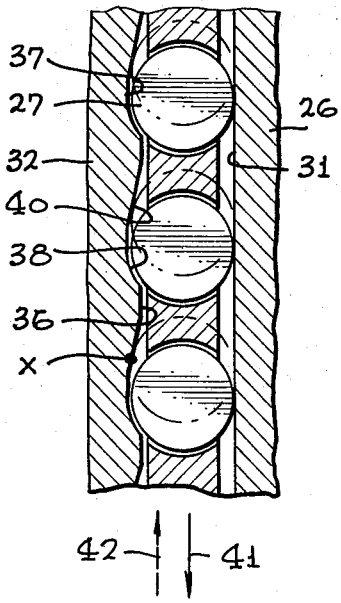
FIG. 3 is an enlarged fragmentary view of the wheel apparatus shown in FIG. 2 as taken in the direction of arrows 3—3 thereof.

Referring now to FIG. 3 in detail, it can be seen that the thrust plate or bearing 32 of the stator assembly includes a raceway surface 36 which is provided with a plurality of cavities indicated in general by the numeral 37. Each cavity includes a circular portion 38 in which the bearing 27 is free to rotate in an unencumbered manner. However, a flat ramp portion 40 is provided which inhibits rolling of the bearing 27 when the periphery of the bearing engages therewith. Therefore, it can be seen that when the bearings are in the circular portion of the cavity 38 the bearings are free to rotate so that the wheel can travel in the direction of arrow 41. However, when the stator has been moved to the position so that the periphery of the bearings engage with the ramp portion of the cavity, such as at point X, then rear movement of the wheel carrying the rotor 26 is prohibited and this is indicated by the broken arrow 42.

Figure 4:
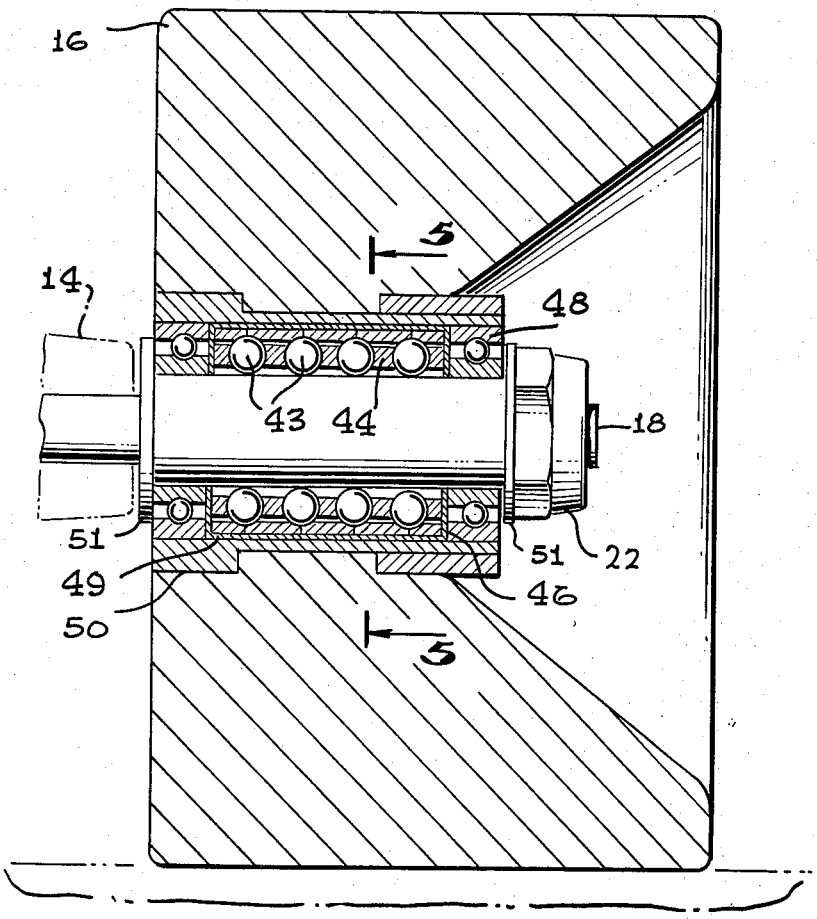
FIG. 4 is a transverse cross-sectional view of another embodiment of the invention.

Another concept for a one-way skate roller is shown in FIG. 4. The disadvantage of this concept over that presented in FIG. 2 is that there is no adjustment to turn "off" the rear direction lock.

Figure 5:
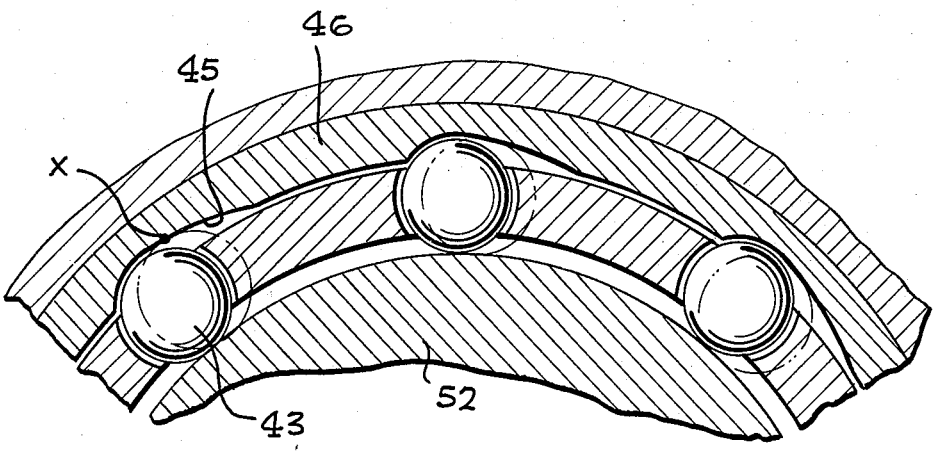
FIG. 5 is a fragmentary cross-sectional view as taken in the direction of arrows 5—5 of FIG. 4.

Referring now to FIG. 4, the skate wheel has a one-way mechanism around the center portion of the axle 18. The mechanism consists of one or more rows of ball bearings 43 retained and spaced evenly around the axle by the cage 44. Each row of bearings rotates in a forward direction around the axle. When the skater does a fast push off, or falls backwards, or skates up an incline, the wheels equipped with the subject invention will not rotate backwards because the balls will tighten against ramps 45 as shown in FIGS. 4 and 5 as previously described. In FIG. 4, four rows of bearings and ramps with cages are shown to achieve a substantial amount of torque, and the entire group of pieces are retained in the cup 46. Radial loads are supported by conventional ball bearings 48. The one-way mechanism and ball bearings are held in the wheel by a housing 49 and a pressed-on collar 50. The entire wheel is held on the skate axle by the skate truck on the inside and by nut 22 on the outside. On either side of the wheel adjacent to the skate truck and nut are washers 51 which allow the wheel to spin freely even if there is side pressure.

FIG. 5 is a sectional view of the one-way mechanism taken through Section 5—5 in FIG. 4. When pressure is exerted on the wheel in a counterclockwise direction, the balls move toward the narrower dimensions of the cavity formed by the cage and housing. This creates a wedging action between the housing and the axle preventing the wheel from turning counterclockwise.

Therefore, it can be seen that the inventive concept of the present invention includes providing a means for selectively prohibiting rotation of a wheel on a skating device in a given direction. In the device shown in FIGS. 1–3 inclusive, roller bearings such as needle or cylindrical bearings may be used while the version shown in FIGS. 4 and 5 is related only to ball bearings.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a roller skate having a support plate and downwardly depending trucks holding a front and a rear axle rollably mounting wheels on the opposite ends thereof, the combination comprising:

a rotor fixed to the inside surface of a wheel;

a stator carried on said truck having a surface in close proximity to said rotor;

a cage having a plurality of bearings thereon rollably engagable with said rotor and said stator surface;

means cooperatively disposed on said rotor and said stator for selectively inhibiting rotation of said wheel in a given direction;

adjusting means operably carried on said truck for urging said stator surface into engagement with said bearings;

said adjusting means including a thrust plate having a manually operated arm thereon for moving said stator towards and away from said caged bearings.

2. The invention as defined in claim 1 wherein:

said stator surface includes a plurality of eccentric cavities, each cavity having a circular portion permitting free rotation of said wheel in either a forward or reverse direction and a flat ramp portion preventing rotation of said wheel when engaged by its associated bearing.

3. The invention as defined in claim 2 wherein:

said adjusting means includes detent means for releasably holding said manually operated arm in fixed position with respect to said truck.

4. The invention as defined in claim 3 wherein:

said rotor includes a smooth, flat raceway rollably engagable with said bearings.

* * * * *